US010869141B2

(12) United States Patent
Albahri et al.

(10) Patent No.: US 10,869,141 B2
(45) Date of Patent: Dec. 15, 2020

(54) AUDIO DEVICE WITH VALVE STATE MANAGEMENT

(71) Applicant: Knowles Electronics, LLC, Itasca, IL (US)

(72) Inventors: Shehab Albahri, Hanover Park, IL (US); Christopher Monti, Elgin, IL (US); Thomas Miller, Arlington Heights, IL (US); Charles King, Oak Park, IL (US)

(73) Assignee: Knowles Electronics, LLC, Itasca, IL (US)

( * ) Notice: Subject to any disclaimer, the term of this patent is extended or adjusted under 35 U.S.C. 154(b) by 0 days.

(21) Appl. No.: 16/236,557

(22) Filed: Dec. 30, 2018

(65) Prior Publication Data

US 2019/0215620 A1 Jul. 11, 2019

Related U.S. Application Data

(60) Provisional application No. 62/614,781, filed on Jan. 8, 2018.

(51) Int. Cl.
*H04R 25/00* (2006.01)
*H04R 1/10* (2006.01)

(52) U.S. Cl.
CPC ..... *H04R 25/505* (2013.01); *H04R 25/456* (2013.01); *H04R 25/554* (2013.01);
(Continued)

(58) Field of Classification Search
CPC .. H04R 1/1008; H04R 1/1016; H04R 1/1041; H04R 1/1083; H04R 25/65;
(Continued)

(56) References Cited

U.S. PATENT DOCUMENTS 2,301,744 A 5/1941 Olsen
3,835,263 A 9/1974 Killion
(Continued)

FOREIGN PATENT DOCUMENTS

CN 1130459 A 9/1996
DE 2614579 A1 10/1977
(Continued)

OTHER PUBLICATIONS

European Patent Office; International Search Report and Written Opinion; International Application No. PCT/US2019/063321; dated Mar. 3, 2020.
(Continued)

*Primary Examiner* — Huyen D Le
(74) *Attorney, Agent, or Firm* — Faegre Drinker Biddle & Reath LLP

(57) ABSTRACT

Methods and apparatus determine the actual state of one or more acoustic valves e.g., whether an acoustic valve is open or closed, in a hearing device. A sensor in the hearing device is configured to generate an output signal indicative of a state of the acoustic valve. An electrical circuit actuates the acoustic valve if the actual state is different than a desired state. The determination of the state of the acoustic valve can be done on the hearing device or on a remote device.

20 Claims, 4 Drawing Sheets

(52) U.S. Cl.
CPC ..... *H04R 25/604* (2013.01); *H04R 25/65* (2013.01); *H04R 1/1016* (2013.01); *H04R 1/1041* (2013.01); *H04R 25/652* (2013.01); *H04R 2225/025* (2013.01); *H04R 2225/61* (2013.01); *H04R 2460/11* (2013.01)

(58) Field of Classification Search
CPC ..... H04R 2225/025; H04R 2225/61; H04R 2460/11; H04R 25/652
USPC ..... 381/71.6, 315, 370, 371, 372, 373, 328, 381/380
See application file for complete search history.

(56) References Cited

U.S. PATENT DOCUMENTS

| | | | | |
|---|---|---|---|---|
| 3,836,732 | A | 9/1974 | Johanson et al. | |
| 3,876,749 | A | 4/1975 | Horvath et al. | |
| 3,975,599 | A | 8/1976 | Johanson | |
| 4,133,984 | A | 1/1979 | Akiyama | |
| 4,142,072 | A | 2/1979 | Berland | |
| 4,605,197 | A | 8/1986 | Casey | |
| 4,756,312 | A | 7/1988 | Epley | |
| 4,800,982 | A | 1/1989 | Carlson | |
| 4,867,267 | A | 9/1989 | Carlson | |
| 4,893,655 | A | 1/1990 | Anderson | |
| 5,033,090 | A | 7/1991 | Weinrich | |
| 5,068,901 | A | 11/1991 | Carlson | |
| 5,220,612 | A | 6/1993 | Tibbetts et al. | |
| 5,259,035 | A | 11/1993 | Peters et al. | |
| 5,349,986 | A | 9/1994 | Sullivan et al. | |
| 5,357,576 | A | 10/1994 | Arndt | |
| 5,524,056 | A | 6/1996 | Killion et al. | |
| 5,631,965 | A | 5/1997 | Chang | |
| 5,692,060 | A | 11/1997 | Wickstrom | |
| 5,757,933 | A | 5/1998 | Preves et al. | |
| 5,785,661 | A | 7/1998 | Shennib | |
| 5,835,608 | A | 11/1998 | Warnaka et al. | |
| 5,990,425 | A | 11/1999 | McSwiggen | |
| 6,068,079 | A | 5/2000 | Hamery et al. | |
| 6,075,869 | A | 6/2000 | Killion et al. | |
| 6,134,334 | A | 10/2000 | Killion et al. | |
| 6,151,399 | A | 11/2000 | Killion et al. | |
| 6,549,635 | B1 | 4/2003 | Gebert | |
| 7,136,497 | B2 | 11/2006 | McSwiggen | |
| 7,458,395 | B2 | 12/2008 | Haynes et al. | |
| 7,478,702 | B2 | 1/2009 | Berg | |
| 7,548,629 | B1 | 6/2009 | Griffin | |
| 7,740,104 | B1 | 6/2010 | Parkins | |
| 7,784,583 | B1 | 8/2010 | Hall | |
| 8,096,383 | B2 | 1/2012 | Saltykov | |
| 8,199,955 | B2 * | 6/2012 | Akino | H04R 1/1008 381/332 |
| 8,338,898 | B2 | 12/2012 | Schrank et al. | |
| 8,391,527 | B2 | 3/2013 | Feucht | |
| 8,798,304 | B2 | 8/2014 | Miller et al. | |
| 8,923,543 | B2 | 12/2014 | Sacha | |
| 9,185,480 | B2 | 11/2015 | Howes | |
| 9,525,929 | B2 * | 12/2016 | Burgett | H04R 1/1041 |
| 2003/0059075 | A1 | 3/2003 | Niederdrank | |
| 2004/0046137 | A1 | 3/2004 | Herbert et al. | |
| 2006/0108552 | A1 | 5/2006 | Herbert et al. | |
| 2006/0137934 | A1 | 6/2006 | Kurth | |
| 2007/0075284 | A1 | 4/2007 | Masamura et al. | |
| 2007/0086599 | A1 | 4/2007 | Wilmink | |
| 2007/0176720 | A1 | 8/2007 | Janssen | |
| 2008/0181443 | A1 | 7/2008 | Harvey et al. | |
| 2010/0111340 | A1 | 5/2010 | Miller | |
| 2011/0182453 | A1 | 7/2011 | Van Hal | |
| 2012/0082335 | A1 | 4/2012 | Duisters | |
| 2014/0169579 | A1 * | 6/2014 | Azmi | G10K 11/16 381/71.6 |
| 2014/0169603 | A1 | 6/2014 | Sacha et al. | |
| 2015/0041931 | A1 | 2/2015 | Szczech et al. | |
| 2016/0150310 | A1 * | 5/2016 | Bakalos | H04R 1/1083 381/372 |
| 2016/0255433 | A1 | 9/2016 | Grinker | |
| 2017/0055086 | A1 | 2/2017 | van Gilst | |
| 2017/0208382 | A1 | 7/2017 | Grinker | |
| 2017/0251292 | A1 | 8/2017 | Wiederholtz | |
| 2018/0091892 | A1 | 3/2018 | Taylor | |
| 2018/0109862 | A1 | 4/2018 | Lawand | |
| 2019/0116436 | A1 | 4/2019 | Lawland | |
| 2019/0116437 | A1 | 4/2019 | Bolsman | |
| 2019/0166238 | A1 | 5/2019 | Gilmore | |
| 2019/0208301 | A1 | 7/2019 | Monti | |
| 2019/0208343 | A1 | 7/2019 | Monti | |
| 2019/0215621 | A1 | 7/2019 | Albahri | |
| 2019/0320272 | A1 | 10/2019 | Jones | |

FOREIGN PATENT DOCUMENTS

| | | | |
|---|---|---|---|
| DE | 4422972 | A1 | 1/1996 |
| EP | 0455203 | A2 | 11/1991 |
| EP | 2747455 | A2 | 6/2014 |
| EP | 3177037 | A2 | 6/2017 |
| EP | 2835987 | | 8/2017 |
| FR | 2596644 | A1 | 10/1987 |
| KR | 10-0517059 | B1 | 9/2005 |
| KR | 1020080001568 | A | 1/2008 |
| WO | 1995007014 | A1 | 3/1995 |
| WO | 1997009864 | A1 | 3/1997 |
| WO | 1997030565 | A1 | 8/1997 |
| WO | 1998047318 | A1 | 10/1998 |
| WO | 1998057081 | A1 | 12/1998 |
| WO | 0027166 | A2 | 5/2000 |
| WO | 2006061058 | A1 | 6/2006 |
| WO | 2007107736 | A2 | 9/2007 |
| WO | 2008022048 | A2 | 2/2008 |
| WO | 2010042613 | A2 | 4/2010 |

OTHER PUBLICATIONS

European Patent Office; Extended European Search Report; EP Application No. 09819815.3; dated Jul. 25, 2013.
European Patent Office; Extended European Search Report; EP Application No. 09819815.3; dated Dec. 22, 2016.
International Search Report and Written Opinion; International Application No. PCT/US2009/059829; dated May 20, 2010.

* cited by examiner

AUDIO DEVICE WITH VALVE STATE MANAGEMENT

RELATED APPLICATIONS

This application relates to U.S. Provisional Patent Application Ser. No. 62/614,781 filed on Jan. 8, 2018, and entitled "Audio Device with Valve State Management," the entire contents of which is hereby incorporated by reference.

TECHNICAL FIELD

This disclosure relates generally to audio devices and, more specifically, to audio devices having acoustic valves.

BACKGROUND

Audio devices are known generally and include hearing aids, earphones and ear pods, among other devices. Some audio devices are configured to provide an acoustic seal (i.e., a "closed fit") with the user's ear. The seal may cause a sense of pressure build-up in the user's ear, known as occlusion, the blocking of externally produced sounds that the user may wish to hear, and a distorted perception of the user's own voice among other negative effects. However, closed-fit devices have desirable effects including higher output at low frequencies and the blocking of unwanted sound from the ambient environment.

Other audio devices provide a vented coupling (i.e., "open fit") with the user's ear. Such a vent allows ambient sound to pass into the user's ear. Open-fit devices tend to reduce the negative effects of occlusion but in some circumstances may not provide optimized frequency performance and sound quality. One such open-fit hearing device is a receiver-in-canal (RIC) device fitted with an open-fit ear dome. RIC devices typically supplement environmental sound with amplified sound in a specific range of frequencies to compensate for hearing loss and aid in communication.

It's known generally to integrate acoustic valves with such devices to adjust a ventilation channel disposed in the acoustic device.

BRIEF DESCRIPTION OF THE DRAWINGS

The objects, features and advantages of the present disclosure will become more fully apparent to those of ordinary skill in the art upon careful consideration of the following Detailed Description and the appended claims in conjunction with the drawings described below.

Figure 1:
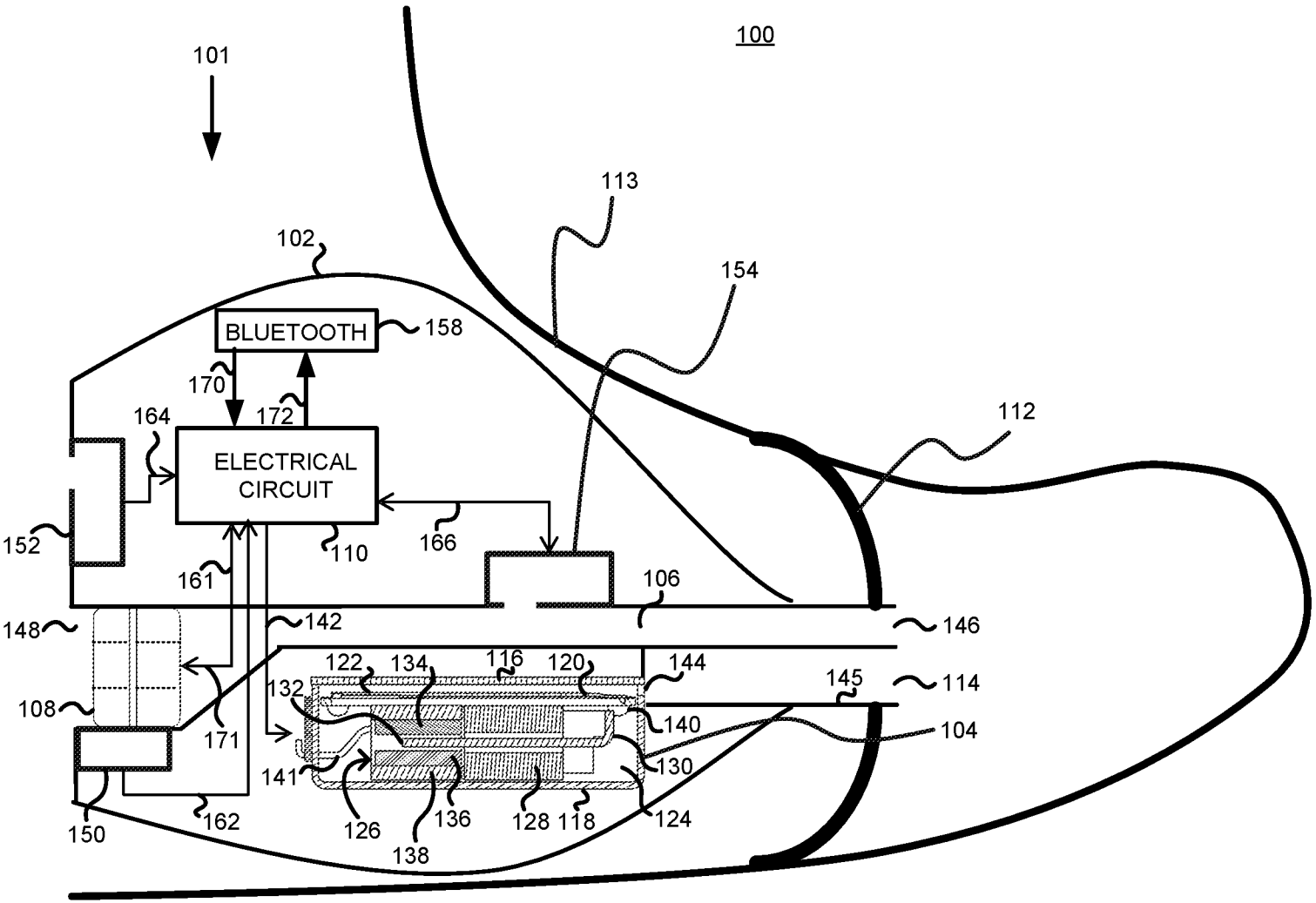
FIG. 1 is a diagram of a hearing device having an acoustic valve.

Elements in the figures are illustrated for simplicity and clarity and have not necessarily been drawn to scale or to include all features, options or attachments. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. The terms and expressions used herein have the ordinary technical meaning as is accorded to such terms and expressions by persons skilled in the technical field as set forth above except where different specific meanings have otherwise been set forth herein.

DETAILED DESCRIPTION

The present disclosure pertains to methods and apparatus for determining the state of one or more acoustic valves, e.g., whether an acoustic valve is open, closed or somewhere in between, in a hearing device. The valve state may be unknown for various reasons including, among others, failure of the valve or an electrical circuit that controls the valve. Also an impact may cause the acoustic valve to inadvertently change states. The disclosed methods, apparatus and systems determine the state acoustic valve. In some embodiments, a sensor in the hearing device is configured to generate an output signal indicative of a state of the acoustic valve. An electrical circuit is configured to actuate the acoustic valve based on the output signal of the sensor so that the acoustic valve is configured in a desired state. The determination of the state of the acoustic valve can be done on the hearing device or on a remote device from the hearing device.

The teachings of the present disclosure are generally applicable to hearing devices including a sound-producing electroacoustic transducer disposed in a housing having a portion configured to form a seal with the user's ear. The seal may be formed by an ear tip or other portion of the hearing device. In some embodiments, the hearing device is a receiver-in-canal (RIC) device for use in combination with a behind-the-ear (BTE) device including a battery and an electrical circuit coupled to the RIC device by a wired connection that extends about the user's ear. The RIC typically includes a sound-producing electro-acoustic transducer disposed in a housing having a portion configured for insertion at least partially into a user's ear canal. In other embodiments, the hearing device is an in-the-ear (ITE) device or a completely-in-canal (CIC) device containing the transducer, electrical circuits and all other components. In another embodiment, the hearing device is a behind-the-ear (BTE) device containing the transducer, electrical circuits and other active components with a sound tube and other passive components that extend into the user's ear. The teachings of the present disclosure are also applicable to over-the-ear devices, earphones, ear buds, and ear pods, in-ear headphones with wireless connectivity, and active noise-canceling (ANC) headphones among other wearable devices that form a sealed coupling with the user's ear and emit sound thereto. These and other applicable hearing devices typically include an electro-acoustic transducer operable to produce sound although the teachings are also applicable to passive hearing devices devoid of a sound producing electro-acoustic transducer, like ear plugs.

In embodiments that include a sound-producing electro-acoustic transducer, the transducer generally includes a diaphragm that separates a volume within a housing of the hearing device into a front volume and a back volume. A motor actuates the diaphragm in response to an excitation signal applied to the motor. Actuation of the diaphragm moves air from a volume of the housing and into the user's ear via a sound opening of the hearing device. Such a transducer may be embodied as a balanced armature receiver or as a dynamic speaker among other known and future transducers.

In some embodiments, the hearing device includes an acoustic vent extending between a portion of the hearing device that is intended to be coupled to the user's ear (e.g., disposed at least partially in the ear canal) and a portion of the hearing device that is exposed to the environment. Actuation of an acoustic valve disposed in or along the acoustic vent alters the passage of sound through the vent thereby configuring the hearing device between a relatively open fit state and a relatively closed fit state. When the acoustic valve is open, the pressure within the ear equalizes with the ambient air pressure outside the ear canal and at least partially allows the passage of low-frequency sound thereby reducing the occlusion effects that are common when the ear canal is fully blocked. Opening the acoustic valve also allows ambient sound outside the ear canal to travel through the sound passage and into the ear canal. Conversely, closing the acoustic valve creates a more complete acoustic seal with the user's ear canal which may be preferable for certain activities, such as listening to music. In other embodiments, the acoustic passage does not extend fully through the housing. For example the passage may vent a volume of the transducer to the ambient atmosphere. Knowledge of the actual state of the valve may be used to ensure that the hearing device is configured properly (e.g., for open fit or closed fit operation).

Figure 2:
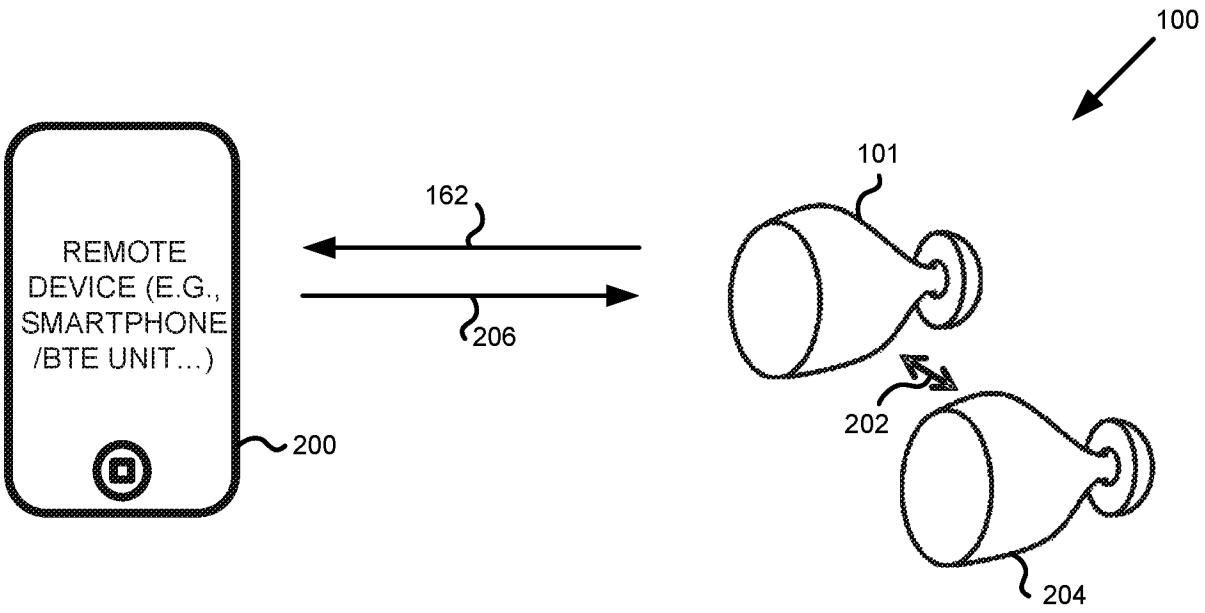
FIG. 2 is a schematic block diagram of a hearing device including two hearables and a remote device.

In FIGS. 1-2 the hearing device 100 includes one or more hearables 101 (and 204 in FIG. 2). The hearing device 100 includes a housing 102 (also referred to as a body), a sound-producing electro-acoustic transducer 104, an acoustic passage 106, an acoustic valve 108 disposed along the acoustic passage 106, and an electrical circuit 110 configured to adaptively actuate the acoustic valve 108 and perform other functions, if desired, as set forth below. The housing 102 has a contact portion 112 which comes into contact with the user's ear (e.g., the ear canal 113) when the hearing device 100 is in use. The contact portion 112 can be replaceable foam, a rubber ear tip, custom molded plastic, or any other suitable material and structure. The housing 102 also defines a sound opening 114 through which sound travels from the electro-acoustic transducer 104 into the user's ear. The electro-acoustic transducer 104 is disposed in the housing 102 and includes a diaphragm 120 which separates the inside volume of the housing into a front volume 122 and a back volume 124. In FIG. 1, the transducer is embodied as a balanced armature receiver including a transducer housing defined by a cover 116 and a cup 118, wherein the front volume 122 is partially defined by the cover 116 and the diaphragm 120 and the back volume is partially defined by the cup 118 and the diaphragm 120. More generally, however, the housing 102 may form a portion, or all, of the transducer housing. Other sound-producing electroacoustic acoustic transducers may be employed including but not limited to dynamic speakers. Also any suitable number of acoustic valves and corresponding passages and acoustic transducers may be employed.

In FIG. 1, the electro-acoustic transducer 104 includes a motor 126 disposed in the back volume 124. The motor 126 includes a coil 128 disposed about a portion of an armature 130. A movable portion 132 of the armature 130 is disposed in equipoise between magnets 134 and 136. The magnets 134 and 136 are retained by a yoke 138. The diaphragm 120 is movably coupled to a support structure 140, and wires 141 extend through the cup 118 of the electro-acoustic transducer 104 for connection to the electrical circuit 110. Application of an electrical excitation signal 142 to the coil 128, through wires 141, modulates the magnetic field, causing deflection of the armature 130 between the magnets 134 and 136. The deflecting armature 130 is linked to the diaphragm 120, wherein movement of the diaphragm 120 forces air through a sound port 144, which is defined by the cover 116 and the cup 118 of the electro-acoustic transducer 104. Movement of the diaphragm 120 results in changes in air pressure in the front volume 122 wherein acoustic pressure (e.g., sound) is emitted through the sound port 144. Armature receivers suitable for the embodiments described herein are available from Knowles Electronics, LLC, however any suitable receiver can be employed. Dynamic speakers also include a motor disposed in a back volume, the operation of which is known generally to those of ordinary skill in the art.

The housing 102 includes the sound opening 114 located in a nozzle 145 of the housing 102. The sound opening 114 is acoustically coupled to the front volume 122, and sound produced by the acoustic transducer emanates from the sound port 144 of the front volume 122 through the sound opening 114 of the housing 102 and into the user's ear. The nozzle 145 also defines a portion of the acoustic passage 106 which extends through the hearing device 100 from a first port 146 defined by the nozzle 145 and acoustically coupled to the user's ear, and a second port 148 which is acoustically coupled to the ambient atmosphere. In another example, the acoustic passage can be partially defined by the volume of the electro-acoustic transducer, although other suitable configurations may also be employed.

Generally, the hearing device includes a sensor for detecting the state of the acoustic valve. The sensor can take many forms including but not limited to, a circuit configured to sense impedance of a valve coil in the acoustic valve in response to a diagnostic signal applied to the valve coil, wherein the impedance of the valve coil is indicative of the state of the acoustic valve. In other embodiments the sensor is a microphone having an output coupled to the electrical circuit or a plurality of microphones positioned in the hearing device. In other embodiments the sensor is a magnetic, e.g., Hall Effect, sensor and/or a capacitive sensor that monitors the state of the acoustic valve. In some embodiments the sensor is embodied as contacts on the acoustic valve, wherein an electrical connection between the contacts is indicative of a state of the acoustic valve. Various examples are discussed herein.

FIG. 1 illustrates various alternative sensors for this purpose, wherein the electrical circuit 110 is coupled to a sensor 150, a first microphone 152, a second microphone 154 and the valve 108. In some embodiments, only one of the sensors shown is required to sense the state of the acoustic valve. Some sensors shown in FIG. 1 may also be used for other purposes. For example, multiple microphones used for acoustic noise cancellation (ANC) may also be used to detect the state of the acoustic valve. The first microphone 152 is placed in or on the housing 102 to be acoustically coupled to the ambient atmosphere, and the second microphone 154 is placed in or on the housing, e.g., in the acoustic passage 106, to be acoustically coupled to the user's ear. The electrical circuit 110 provides a valve control signal 161 to the acoustic valve 108 in order to change the state of the valve 108 between open and closed states, as determined by the electrical circuit 110 or as determined by a remote device that sends a valve state change signal to the hearing device.

In some embodiments, the hearing device includes a wireless communication interface, e.g., Bluetooth, 158, which wirelessly couples the hearing device 100 to a master remote device 200 (see FIG. 2) such as a smart phone, wearable, an internet server, a gateway device or some other device. The hearing device may also include a near field wireless link 202 that couples the first wireless hearable 101 to a second hearable 204 of the hearing device 100 so that acoustic transducer control signals and other signaling can be shared between the hearables 101 and 204 hearables as known in the art.

Generally, the acoustic valve is positioned in an acoustic passage of the housing and is actuatable by an electrical circuit to alter passage of sound through the acoustic passage. An acoustic valve state sensor generates an output signal indicative of a state (e.g., open or closed) of the acoustic valve. The electrical circuit may actuate the acoustic valve based on the output signal of the acoustic valve state sensor depending on the desired state of the valve. Various sensing techniques are employed in different embodiments to determine the current state of the acoustic valve.

The electrical circuit 110 in one example is an integrated circuit, for example a processor coupled to memory such as random access memory (RAM) such as dynamic RAM (DRAM), static RAM (SRAM), read only memory (ROM) and the like, or a driver circuit and includes logic circuitry, to run algorithms to determine state of the acoustic valve and control the acoustic valve. However it will be recognized that some function or operation of the electrical circuit can be distributed among different components if desired, including in the remote device 200.

Figure 4:
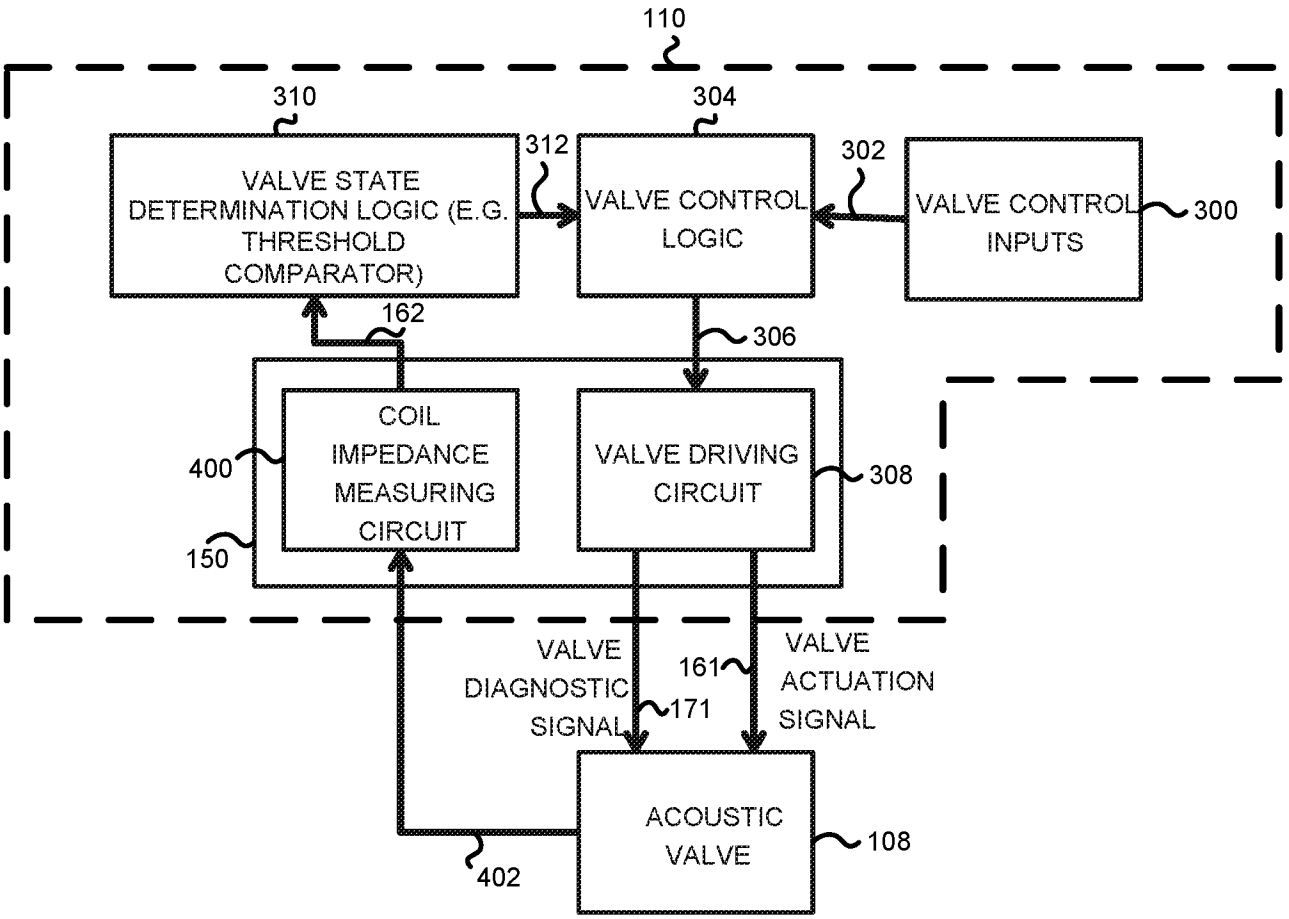
FIG. 4 is an alternative schematic block diagram of a portion of a hearing device.

Referring to FIGS. 1 and 4, where the acoustic valve 108 includes one or more electrical coils, the electrical circuit includes a coil impedance measuring circuit 400 configured to sense impedance of the valve coil in response to a valve diagnostic signal 171 applied to the valve coil by the electric circuit 110. In this example, the valve driving circuit 308 also generates the diagnostic signal 171. However it will be recognized that the diagnostic signal can be generated by any suitable circuit. The impedance 402 detected by the electrical circuit 110 (e.g., circuit 400) in response to the valve diagnostic signal 171 is indicative of the state of the acoustic valve 108. For example, when a valve is closed, a first impedance results whereas when the valve is open a different impedance is detected from the valve coil. In one implementation, the electrical circuit applies an alternating current (AC) diagnostic pulse to the valve coil of the acoustic valve without actuation of the acoustic valve to obtain an impedance measurement. In one example, a brief low-amplitude sinusoidal voltage or current is applied to limit the amount of power used for diagnostic operation. The resulting current or voltage or both are monitored. Electrical impedance is calculated a V/I (voltage divided by current), wherein V and I are frequency dependent vector quantities that can be expressed as having a magnitude and phase or real and imaginary parts. At lower frequencies (e.g. <100 Hz) the real part of the impedance characterized by resistance of the valve coil and connections dominates. At higher frequencies (e.g. >100 Hz) the imaginary part of the impedance characterized by valve coil inductance becomes an important contributor to impedance. The impedance of the electrical circuit is dependent not just on the valve coil but also the geometry of nearby ferromagnetic or permanent magnet material. The location of a moving magnetic (ferromagnetic or permanent magnetic or both) component of the valve can then be indicated by differences in the electrical impedance of the circuit at some high frequency (e.g. 10,000 Hz.). Alternatively, the valve coil may be moving and the magnetic material may be stationary.

The valve circuit has a first electrical impedance at a frequency when the valve coil and surrounding magnetic material have a first relative position that is indicative of an open state. The valve circuit will have a second electrical impedance at the frequency when the valve coil and surrounding magnetic material have a second relative position that is indicative of a closed state. A third impedance may indicate that the acoustic valve is partially open or partially closed as may occur if the valve is damaged. The third state could also be an intended state of a multistate valve. If the valve is damaged, a failure notification may be provided or stored in a memory device of the hearing device. The failure notification can be in any suitable form in including but not limited to an LED indication on the hearable that has the problem, an audible notification through the acoustic transducer, the notification can be sent to the remote device which then generates a user notification through a user interface on the remote device or a signal to the hearable, or the failure notification can be sent to a server that logs the event. In the event that a valve may not be properly actuated to the desired state similar notification protocols may be employed. Instead of the hearables 101 and 204 performing the impedance determination operation or other valve state determination operation, the impedance determination or valve state determination may be performed at the remote device, such as a smart phone 200 in FIG. 2, web server, wearable or other remote device. The remote device may then provide a valve actuation signal to the hearing device if actuation is required.

Instead of using a valve coil impedance measurement, the acoustic valve state sensor can be implemented as a microphone having an output that is received by the electrical circuit 110. In one implementation, a microphone, e.g., microphone 152 or 154 in FIG. 1, may sense sound associated with the actuation of the acoustic valve. In FIG. 2, the state determination logic 310 may determine the valve state change based on acoustic signatures associated with the transition into different valve states. Such signatures may be determined empirically for opening and closing of the valve and the signatures may be used by an algorithm executed at the hearing device or at a remote device to determine the state of the valve.

In another implementation, the acoustic valve state sensor may be embodied as multiple microphones. In FIG. 1, for example, the microphone 152 detects ambient sound when a portion of the housing is coupled to the user's ear and the microphone 154 that is located to detect sound within the user's ear when the hearable is in the user's ear. The electrical circuit determines the state of the valve based on output signals from the microphone 152 and 154. For example, a comparison of the microphone signals can indicate that the degree to which sound is passing between the ear canal of the user and the ambient atmosphere or between the ambient atmosphere and the ear canal of the user. In another example, the relationship between the frequency content of the first microphone and the frequency content of the second microphone is indicative of the state of the valve.

Figure 3:
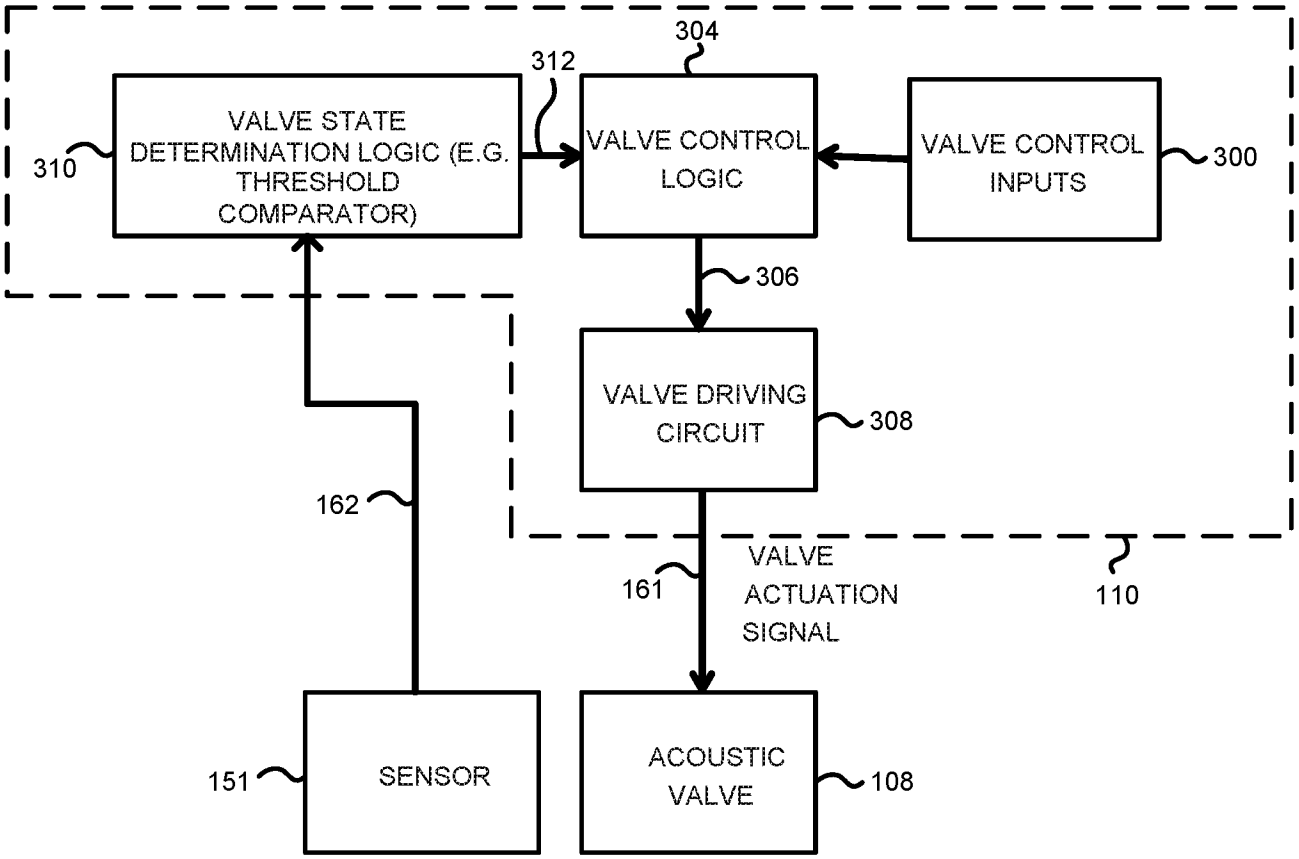
FIG. 3 is a schematic block diagram of a portion of a hearing device.

In another example, the acoustic valve state sensor is a magnetic, e.g., Hall Effect, sensor that generates a signal indicative of the state of the acoustic valve and transmits the detected signal to the electrical circuit 110. In this example, the magnetic sensor may detect movement of the ferromaterial (e.g., armature) in the acoustic valve. In yet another example, the acoustic valve state sensor is embodied as a copacative sensor that detects a capacitance between moving and non-moving part of the acoustic valve, wherein different capacitance values are associated with different valve states. In another example, the acoustic valve state sensor may be implemented as contacts on the acoustic valve wherein an electrical connection between the contacts is indicative of a state of the acoustic valve. For example, the contacts are placed such that the contacts form an open or closed circuit depending on the state of the valve. In FIG. 1 and FIG. 3, the magnetic sensor, the capacitive sensor and the contacts sensors are represented schematically by the generic sensor 150 located proximate the acoustic valve.

FIG. 2 illustrates a hearing device 100 comprising first and second hearables 101 and 204 for the user's right and left ears, respectively. Each device 101 and 204 includes an ear contact portion, a transducer and a sound passage with an acoustic valve, an electrical circuit with an acoustic valve driver and a sensor for determining the state of the valve. The device 101 and 204 may be coupled to a remote device 200 like a smartphone via a wireline or a wireless connection, for example Bluetooth, interface. The first and second devices 101 and 204 may also be coupled wirelessly as master-slave device, for example, by a Near Field Magnetic Induction (NMFI) interface. In FIG. 1, a Bluetooth chip 158 serves as a wireless communication interface the supports the conveyance of content or voice between the hearing device and the remote device.

In FIG. 3, the electrical circuit 110 includes valve control inputs 300 that receive valve state control signals. The valve control inputs can be provided manually by the user or by a remote source or by an algorithm implemented on the hearing device. The valve control logic 304 provides a (e.g., open or close) signal 306 to the valve driver circuit 308 based on the valve control input 300. The valve driver circuit responsively provides an actuation signal 161 to acoustic valve 108. The actuation signal may be in the form of a short pulse of sufficient duration and amplitude to actuate the valve, wherein the polarity of the pulse may be changed to open or close the valve. The pulse may be a square-shaped pulse, half-sine, exponential, or any other suitable shape to achieve actuation. At least the acoustic valve 108 and the valve driving circuit 308 are disposed on the hearing device. The valve control logic 304 can be part of the electrical a circuit on the hearing device or it can be implemented on an electrical circuit of a remote device or on both.

FIG. 3 also shows the acoustic valve state sensor 151 that generates an output that may be indicative of the state of the acoustic valve. In FIG. 4, the impedance measuring circuit generates an analogous signal. In FIGS. 3 and 4, the valve state determination logic 310 receives the output signal of the valve state sensor and may perform some processing thereon to determine the state of the acoustic valve. Such processing may include noise filtering, bandwidth filtering, comparison to a threshold, and other processing depending on the type of sensor. The valve state determination logic 310 sends a valve state signal to the valve control logic 304. The valve control logic compares the valve state signal from the logic 310 to the desired valve state indicated by the valve control inputs. If the actual valve state determined by the logic 310 is different than the desired valve state, the valve control logic may send a signal 306 to the valve driving circuit to change the state of the acoustic valve. In some embodiments, the valve state determination logic may be indeterminate. In such cases, an indeterminate valve state signal is sent to the valve control logic, which sends another control signal to the valve driver circuit under the assumption that the valve state is not the desired valve state. An error signal may be generated if the valve state determination logic is unable to determine a valve state after one or more attempts to reset the acoustic valve. Such an error signal may be stored for later interrogation or it may be used to provide a user alert, like a light, vibration or audio code, for example. Also, the determination of whether a valve state change is necessary to change the actual state of the valve to the desired state can be done at power up of the hearing device, periodically during operation of the hearing device, when a state change of the valve is detected or at any other time.

The valve state determination logic can be implemented in either the hearing device or in a remote device like a smart phone. In embodiments where the valve state determination functionality is performed in the remote device, the hearing device transmits the valve state sensor signal to the remote device. In this example, the remote device determines the valve state by processing the sensor signal and thereafter transmits the valve state information to the hearing device. The valve control logic may also be implemented in the hearing device or in the remote device. If the valve control logic is implemented in the remote device, the remote device communicates the valve actuation signal to the valve driving circuit in the hearing device.

The electrical circuit can be implemented in hardware or in both hardware and software (including firmware). For example, the valve state determination logic and the valve control logic can be implemented in a programmable processor. The sensors can be implemented as hardware. For example, the impedance measuring circuit can be implemented as a current measuring resistor or voltage measuring resistor or both.

While the present disclosure and what is presently considered to be the best mode thereof has been described in a manner that establishes possession by the inventors and that enables those of ordinary skill in the art to make and use the same, it will be understood and appreciated that in light of the description and drawings there are many equivalents to the exemplary embodiments disclosed herein and that myriad modifications and variations may be made thereto without departing from the scope and spirit of the disclosure, which is to be limited not by the exemplary embodiments but by the appended claimed subject matter and its equivalents.

The invention claimed is:

1. A hearing device comprising:

a housing having a contact portion configured to form a substantially sealed coupling with a user's ear, the housing having a sound opening;

an electro-acoustic transducer disposed in the housing, the transducer configured to generate an acoustic signal in response to an electrical excitation signal applied thereto, wherein an acoustic signal generated by the transducer emanates into the user's ear via the sound opening when the portion of the housing is coupled to the user's ear;

an acoustic valve disposed in an acoustic passage of the housing, the acoustic valve actuatable to alter passage of sound through the acoustic passage;

a sensor configured to generate an output signal indicative of a state of the acoustic valve;

an electrical circuit configured to actuate the acoustic valve based on the output signal of the sensor.

2. The device of claim 1, the acoustic valve includes an electrical valve coil, the sensor is a circuit configured to sense impedance of the valve coil in response to a diagnostic signal applied to the valve coil, wherein the impedance of the valve coil is indicative of the state of the acoustic valve.

3. The device of claim 2, the electrical circuit is configured to apply an AC diagnostic pulse to the valve coil without actuation of the valve.

4. The device of claim 1, the sensor is a microphone having an output coupled to the electrical circuit.

5. The device of claim 1, wherein the sensor includes a first microphone located on the hearing device to detect ambient sound when the contact portion of the housing is coupled to the user's ear; and a second microphone located on the hearing device to detect sound within the user's ear when the contact portion of the housing is coupled to the user's ear, wherein the electrical circuit is configured to determine the state of the valve based on output signals of the first and second microphones.

6. The device of claim 1, the sensor is a Hall Effect device having an output coupled to the electrical circuit.

7. The device of claim 1, the sensor is a capacitive sensor having an output coupled to the electrical circuit.

8. The device of claim 1, the sensor includes contacts on the acoustic valve, wherein an electrical connection between the contacts is indicative of a state of the acoustic valve.

9. The device of claim 1, wherein the contact portion of the housing is configured for insertion at least partially into a user's ear canal.

10. The device of claim 1, wherein the electrical circuit is configured to determine a state of the valve based on the output signal of the sensor.

11. The device of claim 1 further comprising a wireless communication interface, wherein the electrical circuit configured to actuate the acoustic valve based on a signal received from a remote device via the wireless communication interface, wherein determination of the state of the valve occurs at the remote device.

12. The device of claim 1, the acoustic passage including a first port acoustically coupled to a volume within the user's ear when the contact portion of the housing is coupled to the user's ear, and the acoustic passage including a second port coupled to ambient atmosphere when the contact portion of the housing is coupled to the user's ear.

13. The device of claim 1 wherein the electrical circuit is configured to compare a state of the valve based on the output signal from the sensor to a desired state of the valve and actuate the acoustic valve based on the comparison.

14. A hearing device comprising:

a housing having a contact portion configured to form a substantially sealed coupling with a user's ear, the housing having a sound opening;

an electro-acoustic transducer disposed in the housing, the transducer configured to generate an acoustic signal in response to an electrical excitation signal applied thereto, wherein an acoustic signal generated by the transducer emanates into the user's ear via the sound opening when the portion of the housing is coupled to the user's ear;

an acoustic valve disposed in an acoustic passage of the housing, the acoustic valve actuatable to alter passage of sound through the acoustic passage;

a sensor configured to generate an output signal indicative of a state of the acoustic valve;

an electrical circuit configured to determine a state of the valve based on an output signal of the sensor.

15. The device of claim 14, the acoustic valve includes an electrical valve coil, the sensor is a circuit configured to sense impedance of the valve coil in response to a diagnostic signal applied to the valve coil, wherein the impedance of the valve coil is indicative of the state of the acoustic valve.

16. The device of claim 15, the electrical circuit is configured to apply an AC diagnostic pulse to the valve coil without actuation of the valve.

17. The device of claim 15, wherein the contact portion of the housing is configured for insertion at least partially into a user's ear canal.

18. The device of claim 15, the acoustic passage including a first port acoustically coupled to a volume within the user's ear when the contact portion of the housing is coupled to the user's ear, and the acoustic passage including a second port coupled to ambient atmosphere when the contact portion of the housing is coupled to the user's ear.

19. The device of claim 14, the sensor is a microphone having an output coupled to the electrical circuit.

20. The device of claim 14, wherein the sensor includes a first microphone located on the hearing device to detect ambient sound when the contact portion of the housing is coupled to the user's ear; and a second microphone located on the hearing to detect sound within the user's ear when the contact portion of the housing is coupled to the user's ear, wherein the electrical circuit is configured to determine the state of the valve based on output signals of the first and second microphones.

* * * * *